US011007785B2

(12) United States Patent
Tojo

(10) Patent No.: US 11,007,785 B2
(45) Date of Patent: May 18, 2021

(54) WASTE LIQUID CONTAINER AND ATTACHMENT

(71) Applicant: SEIKO EPSON CORPORATION, Tokyo (JP)

(72) Inventor: Seiji Tojo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 16/571,621

(22) Filed: Sep. 16, 2019

(65) Prior Publication Data

US 2020/0086649 A1 Mar. 19, 2020

(30) Foreign Application Priority Data

Sep. 18, 2018 (JP) ..... JP2018-173330

(51) Int. Cl.
*B41J 2/17* (2006.01)
*B41J 2/185* (2006.01)

(52) U.S. Cl.
CPC ..... *B41J 2/1721* (2013.01); *B41J 2/185* (2013.01); *B41J 2002/1728* (2013.01); *B41J 2002/1856* (2013.01)

(58) Field of Classification Search
CPC .. B41J 2/1721; B41J 2/16523; B41J 2/16508; B41J 2/1752; B41J 2/185; B41J 2002/1728; B41J 2002/1856
See application file for complete search history.

(56) References Cited

U.S. PATENT DOCUMENTS

| | | | | |
|---|---|---|---|---|
| 6,132,036 | A | 10/2000 | Abe et al. | |
| 7,431,438 | B2 * | 10/2008 | Tsujimoto | B41J 2/16523 347/31 |
| 9,085,162 | B2 * | 7/2015 | Tsuyama | B41J 2/1721 |
| 9,862,191 | B2 * | 1/2018 | Maruyama | B41J 2/16508 |
| 2012/0236074 | A1 | 9/2012 | Harada et al. | |
| 2015/0375509 | A1 | 12/2015 | Harada et al. | |

FOREIGN PATENT DOCUMENTS

| | | | |
|---|---|---|---|
| JP | H09-076525 | A | 3/1997 |
| JP | 2012-196804 | A | 10/2012 |
| JP | 2016-010900 | A | 1/2016 |

* cited by examiner

*Primary Examiner* — John Zimmermann
(74) *Attorney, Agent, or Firm* — Workman Nydegger

(57) ABSTRACT

A waste liquid container includes a waste liquid introduction portion being coupled to a discharge portion when the waste liquid container is mounted on a mounting portion, an accommodation portion accommodating waste liquid discharged from the discharge portion, and a restricted portion having a contact portion configured to make contact with a restricting portion and restricting movement of the waste liquid container in a detachment direction opposite to a mounting direction by contact between the contact portion and the restricting portion in a state in which the waste liquid container is mounted on the mounting portion, wherein the contact portion is arranged at a position which does not overlap with a center of an opening of the waste liquid introduction portion in a vertical direction when seen from a side on which the waste liquid introduction portion is opened.

10 Claims, 8 Drawing Sheets

WASTE LIQUID CONTAINER AND ATTACHMENT

The present application is based on, and claims priority from JP Application Serial Number 2018-173330, filed Sep. 18, 2018, the disclosure of which is hereby incorporated by reference herein in its entirety.

BACKGROUND

1. Technical Field

The present disclosure relates to a waste liquid container and an attachment.

2. Related Art

For example, an existing waste liquid container disclosed in JP-A-2016-10900 has been known as an example of waste liquid containers capable of being mounted on liquid ejecting apparatuses. A to-be-inserted portion is provided on a front wall of such a waste liquid container, and the to-be-inserted portion of the waste liquid container is inserted into a discharge portion provided on a liquid ejecting apparatus in a state in which the waste liquid container is mounted on the liquid ejecting apparatus. Waste liquid used in the liquid ejecting apparatus is discharged into the waste liquid container after passing through the discharge portion.

A to-be-locked portion is provided on a bottom wall of the waste liquid container, and a separation movement restricting portion provided on the liquid ejecting apparatus makes contact with the to-be-locked portion of the waste liquid container in the state in which the waste liquid container is mounted on the liquid ejecting apparatus. As a result, a positioning state of the waste liquid container mounted on the liquid ejecting apparatus becomes stable.

In the waste liquid container disclosed in JP-A-2016-10900, the to-be-locked portion is however located at a position under a center of an opening of the to-be-inserted portion in the vertical direction. The waste liquid leaked out from the to-be-inserted portion therefore adheres to the to-be-locked portion while flowing down the front wall of the waste liquid container and is transferred onto the liquid ejecting apparatus in some cases. In this case, there is a risk that the waste liquid transferred onto the liquid ejecting apparatus is transferred also onto a waste liquid container newly mounted on the liquid ejecting apparatus.

SUMMARY

According to an aspect of the present disclosure, a waste liquid container that is mounted on a mounting portion in a detachable manner with movement in a mounting direction intersecting with a gravity direction having a discharge portion for discharging waste liquid and a restricting portion provided under the discharge portion includes a waste liquid introduction portion being coupled to the discharge portion when the waste liquid container is mounted on the mounting portion, an accommodation portion accommodating the waste liquid discharged from the discharge portion, and a restricted portion having a contact portion configured to make contact with the restricting portion and restricting movement of the waste liquid container in a detachment direction opposite to the mounting direction by contact between the contact portion and the restricting portion in a state in which the waste liquid container is mounted on the mounting portion, in which the contact portion is arranged at a position that does not overlap with a center of an opening of the waste liquid introduction portion in a vertical direction when seen from a side on which the waste liquid introduction portion is opened.

BRIEF DESCRIPTION OF THE DRAWINGS

FIG. 6A is a front view, FIG. 6B is a plan view, FIG. 6C is a left side view, FIG. 6D is a right side view, FIG. 6E is a rear view, and FIG. 6F is a bottom view.

DESCRIPTION OF EXEMPLARY EMBODIMENTS

Hereinafter, one embodiment embodying a waste liquid container and a liquid ejecting apparatus will be described with reference to the drawings.

Figure 1:
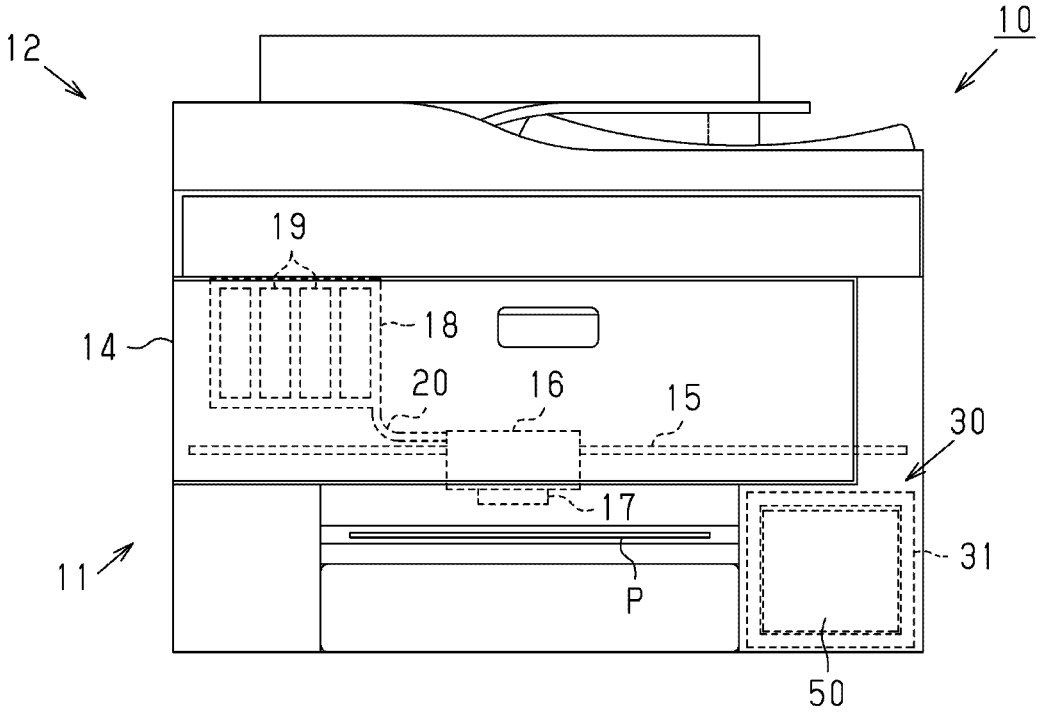
FIG. 1 is a front view of a complex machine including a waste liquid container according to one embodiment.

As illustrated in FIG. 1, a complex machine 10 includes a recording unit 11 as an example of a liquid ejecting apparatus and an image reading unit 12 reading an image drawn on a to-be-read medium. The recording unit 11 and the image reading unit 12 are arranged side by side in an up-down direction.

The recording unit 11 is an ink jet printer and includes a recording unit case 14 configuring a housing of the liquid ejecting apparatus. A guide member 15 extending in a main-scanning direction and a carriage 16 supported on the guide member 15 in a state of being movable in the main-scanning direction are provided in the recording unit case 14. The carriage 16 reciprocates in the main-scanning direction with the driving of a carriage motor. A recording head 17 is provided on the carriage 16. The recording head 17 has nozzles for ejecting ink as an example of liquid. Recording is performed on paper P by ejecting ink from the recording head 17 while moving the carriage 16 in the main-scanning direction.

A cartridge holder 18 is provided on a left side in the drawing in the recording unit case 14. A plurality of ink cartridges 19 accommodating ink therein is mounted on the cartridge holder 18 in a detachable manner. The ink in the ink cartridges 19 thus mounted on the cartridge holder 18 is supplied to the recording head 17 after passing through an ink supply tube 20.

A maintenance device 30 that performs maintenance on an ink supply system including the recording head 17 is provided on a right side in the drawing in the recording unit case 14. A mounting portion 31 is provided on the maintenance device 30 and a waste liquid container 50 is mounted on the mounting portion 31 in a detachable state. The maintenance by the maintenance device 30 causes the ink discharged from the recording head 17 to be discharged to the waste liquid container 50.

Figure 2:
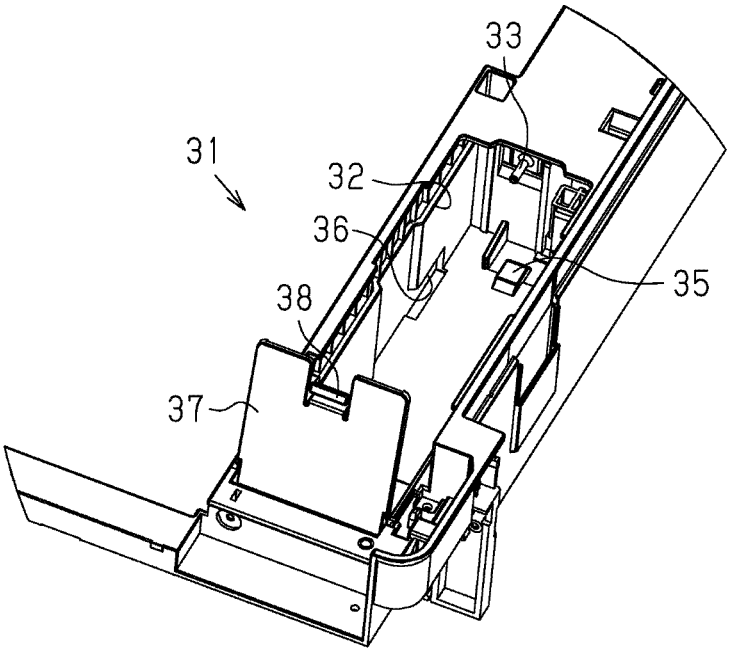
FIG. 2 is a perspective view of a mounting portion on which the waste liquid container in the embodiment is mounted.
Figure 3:
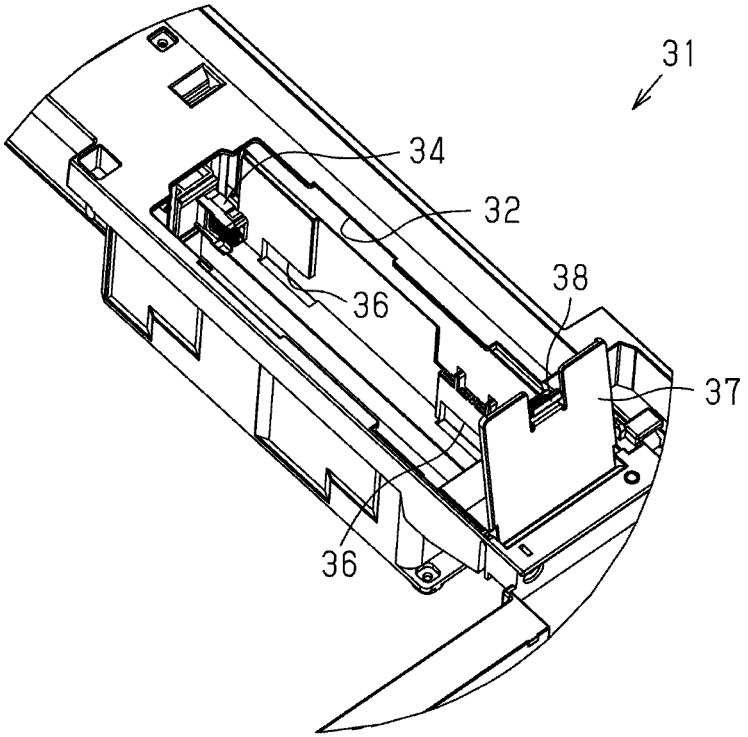
FIG. 3 is a perspective view of the mounting portion on which the waste liquid container in the embodiment is mounted.

As illustrated in FIGS. 2 and 3, a mounting recess portion 32 extending long in one direction is provided in the mounting portion 31. The waste liquid container 50 is mounted on the mounting portion 31 and is detached from the mounting portion 31 through an opening of the mounting recess portion 32.

Figure 4:
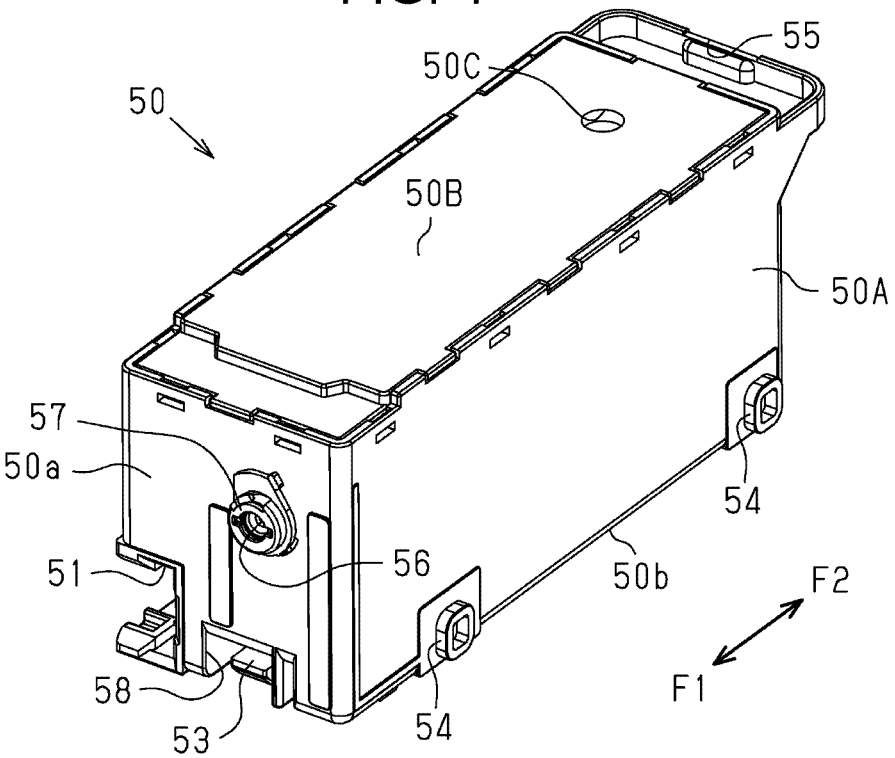
FIG. 4 is a perspective view of the waste liquid container in the embodiment.
Figure 6A:
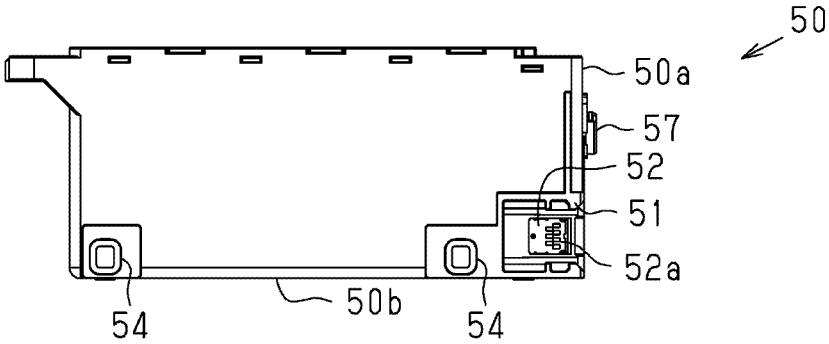
FIGS. 6A to 6F are views illustrating the waste liquid container in the embodiment.
Figure 6B:
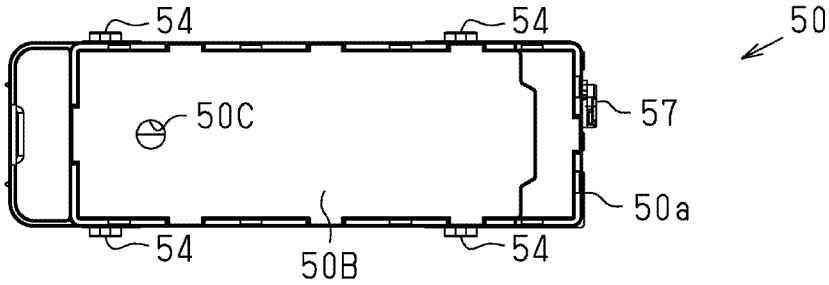
Figure 6C:
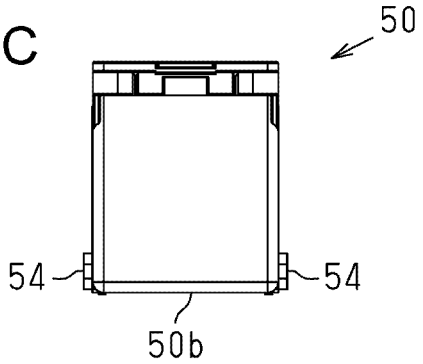

A discharge portion 33 and a substrate connecting portion 34 are provided on a side surface of the mounting recess portion 32, which is located on a first end portion thereof in the lengthwise direction. The discharge portion 33 has a cylindrical shape and discharges the waste liquid discharged from the recording head 17. The substrate connecting portion 34 is electrically coupled to a control device of the complex machine 10. The substrate connecting portion 34 has a projecting piece shape and is inserted into a recess portion 51 (see FIG. 4) provided in a side wall of the waste liquid container 50 along the projecting direction of the substrate connecting portion 34. The substrate connecting portion 34 is electrically connected to a connecting terminal 52*a* of a circuit substrate 52 (see FIG. 6A) provided in the recess portion 51. The circuit substrate 52 is arranged such that the connecting terminal 52*a* directs to an outer side in a width direction of the waste liquid container 50 as a direction intersecting with both of the gravity direction and a mounting direction F1 of the waste liquid container 50.

Figure 5:
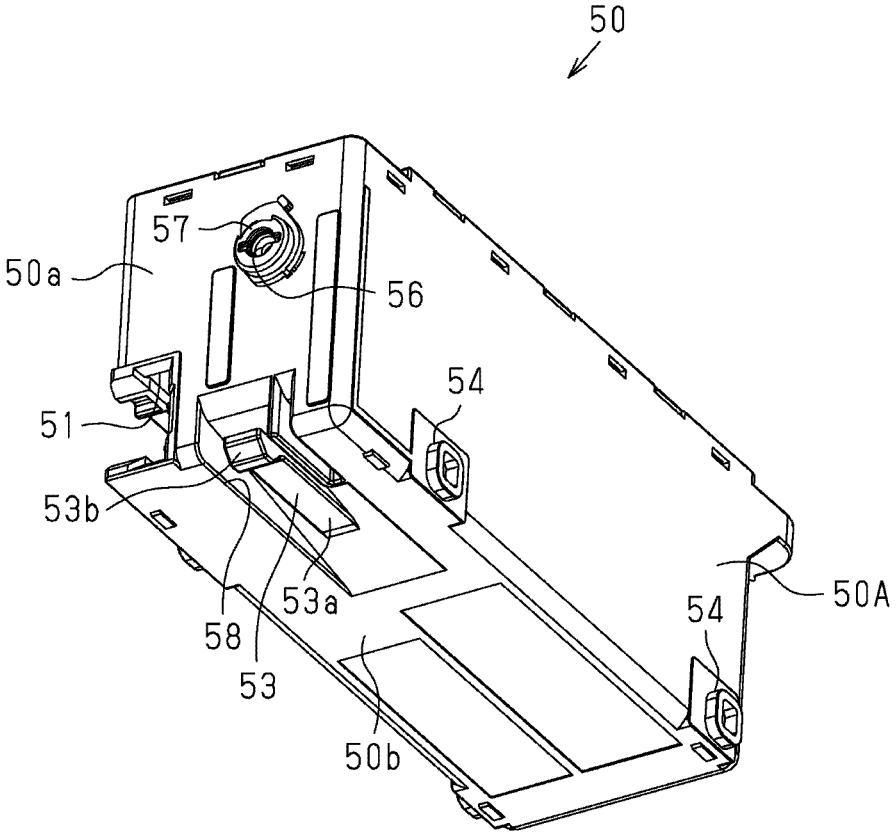
FIG. 5 is a perspective view of the waste liquid container in the embodiment.

A restricting portion 35 having a projecting shape is provided on a bottom surface of the mounting recess portion 32. The restricting portion 35 has a trapezoidal side view shape when seen from the direction intersecting with the mounting direction F1 of the waste liquid container 50. The upper surface of the restricting portion 35 is configured by a first surface 35A, a second surface 35B, and a third surface 35C arranged side by side in the mounting direction F1 of the waste liquid container 50 (see FIG. 11A). The first surface 35A is configured as a sloped surface with a downward gradient in the mounting direction F1 of the waste liquid container 50. The second surface 35B is configured as a horizontal face with no gradient in the mounting direction F1 of the waste liquid container 50. The third surface 35C is configured as a sloped surface with an upward gradient in the mounting direction F1 of the waste liquid container 50. When the waste liquid container 50 accommodated in the mounting recess portion 32 is moved in the mounting direction F1, a restricted portion 53 (see FIG. 5) formed on a bottom wall portion of the waste liquid container 50 is engaged with the restricting portion 35 formed on the bottom surface of the mounting recess portion 32 in the direction along the mounting direction F1 of the waste liquid container 50. This engagement positions the waste liquid container 50 on the mounting recess portion 32 in the direction along the mounting direction F1.

Guide portions 36 having a recess shape are provided in side surfaces of the mounting recess portion 32. The guide portions 36 have a groove shape extending in the direction along the mounting direction F1 of the waste liquid container 50. When the waste liquid container 50 accommodated in the mounting recess portion 32 is moved in the mounting direction F1, guided portions 54 (see FIG. 4) formed on side wall portions of the waste liquid container 50 are engaged with the guide portions 36 formed in the side surfaces of the mounting recess portion 32 in the direction along the mounting direction F1 of the waste liquid container 50. The guide portions 36 are engaged with the guided portions 54, so that the waste liquid container 50 is guided so as to be movable in the direction along the mounting direction F1.

A cover member 37 is mounted, in a rotationally movable manner, on an opening edge of the mounting recess portion 32, which is located on a second end portion thereof in the lengthwise direction. An engagement claw 38 is provided on a front end portion of the cover member 37, which is farther from a rotational movement center. When the cover member 37 rotationally moves to a position at which it makes contact with the waste liquid container 50 in a state in which the waste liquid container 50 is positioned on the mounting recess portion 32, the engagement claw 38 of the cover member 37 is engaged with an engagement portion 55 (see FIG. 4) formed on the waste liquid container 50. A mounting positioning state of the waste liquid container 50 on the mounting portion 31 is thereby stable.

Next, the configuration of the waste liquid container 50 will be described with reference to the drawings.

As illustrated in FIGS. 4 and 5, and 6A to 6F, the waste liquid container 50 includes a container member 50A made of synthetic resin. The container member 50A has a bottomed rectangular prismatic shape the upper side of which is open and the upper opening of the container member 50A is covered by a lid member 50B. An atmosphere open hole 50C is formed in the lid member 50B.

A front wall portion 50*a* on the front side of the container member 50A in the mounting direction F1 is arranged to be close to the first end portion of the mounting recess portion 32 in the lengthwise direction when mounted on the mounting portion 31. An introduction port 56 corresponding to a waste liquid introduction portion into which the discharge portion 33 of the mounting portion 31 is inserted is provided in the front wall portion 50*a* of the container member 50A at a position close to a center thereof in the height direction. An annular projecting portion 57 projects on the periphery of the introduction port 56. When the waste liquid container 50 is mounted on the mounting portion 31, the discharge portion 33 provided on the mounting portion 31 is inserted into the introduction port 56 through an opening of the annular projecting portion 57.

A recess portion 58 opened to the front side and the lower side of the container member 50A is formed in a bottom wall portion 50*b* of the container member 50A. That is to say, the recess portion 58 is opened to the gravity direction and the mounting direction F1 of the container member 50A. The recess portion 58 extends to reach a position close to a center of the bottom wall portion 50*b* of the container member 50A from the front wall portion 50*a* of the container member 50A.

The recess portion 58 of the container member 50A accommodates therein the restricted portion 53 that is engaged with the restricting portion 35 provided on the bottom surface of the mounting recess portion 32 when the waste liquid container 50 is mounted on the mounting portion 31. The restricted portion 53 has a thin plate shape extending long in one direction. A first end portion of the restricted portion 53 in the lengthwise direction is not coupled to the recess portion 58, and a second end portion of the restricted portion 53 in the lengthwise direction is coupled to the recess portion 58. That is to say, the restricted portion 53 is supported by the recess portion 58 in a cantilever structure. In this case, the first end portion of the restricted portion 53 in the lengthwise direction does not project in the mounting direction F1 of the container member 50A from the front wall portion 50*a* of the container member 50A. The restricted portion 53 has a deformation portion 53*a* configured to be elastically deformable in the direction intersecting with the lengthwise direction of the restricted portion 53 and a contact portion 53*b* provided on the front end of the deformation portion 53*a*. The contact portion 53*b* indicates only a portion of a projecting portion toward the lower side of the container member 50A, which actually makes contact with the restricting portion 35 when the waste liquid container 50 is mounted on the mounting portion 31, the projecting portion being provided on the front end of the deformation portion 53*a*. The second end portion of the restricted portion 53 in the lengthwise direction is arranged on a detachment direction F2 side relative to the contact portion 53*b*. When the waste liquid container 50 is mounted on the mounting portion 31, the contact portion 53*b* is engaged with the first surface 35A of the restricting portion 35. With this engagement, the waste liquid container 50 is positioned on the mounting recess portion 32 in the direction along the mounting direction F1.

The guided portions 54 that are engaged with the guide portions 36 provided in the side surfaces of the mounting recess portion 32 when the waste liquid container 50 is mounted on the mounting portion 31 are provided on the side walls of the container member 50A. The guided portions 54 are configured by a plurality of projecting portions. Movement of the guided portions 54 in the mounting direction F1 of the waste liquid container 50 is guided by the guide portions 36. The guided portions 54 are arranged on the detachment direction F2 side of the waste liquid container 50 relative to the circuit substrate 52.

Figure 6D:
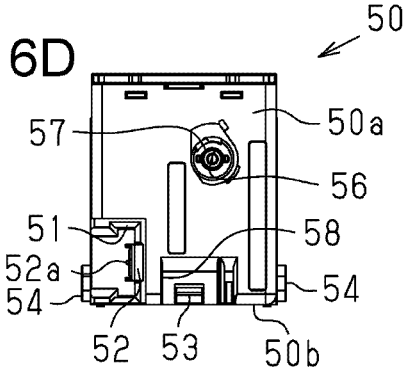
Figure 6E:
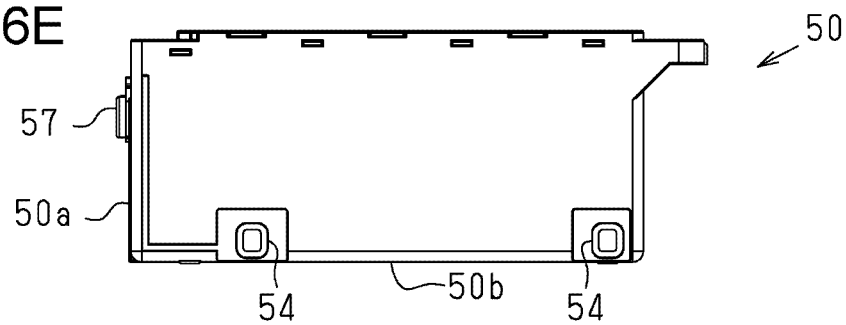
Figure 6F:
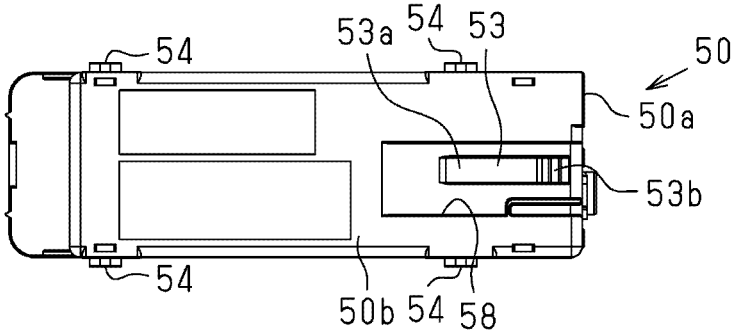

As illustrated in FIG. 6D, in the container member 50A, the introduction port 56 is arranged on the upper side relative to the contact portion 53*b* of the restricted portion 53. In the container member 50A, a center of an opening of the introduction port 56 and the contact portion 53*b* of the restricted portion 53 are arranged at positions that do not overlap with each other in the vertical direction when seen from the front wall portion 50*a* side on which the introduction port 56 is provided. The center of the opening of the introduction port 56 and the recess portion 58 are arranged at positions that overlap with each other in the vertical direction when seen from the same direction.

As illustrated in the same drawing, in the container member 50A, the connecting terminal 52*a* of the circuit substrate 52 is arranged on the upper side relative to the restricted portion 53. In the container member 50A, the recess portion 51 accommodating therein the circuit substrate 52 and the recess portion 58 accommodating therein the restricted portion 53 are separated from each other without communicating with each other.

Figure 7:
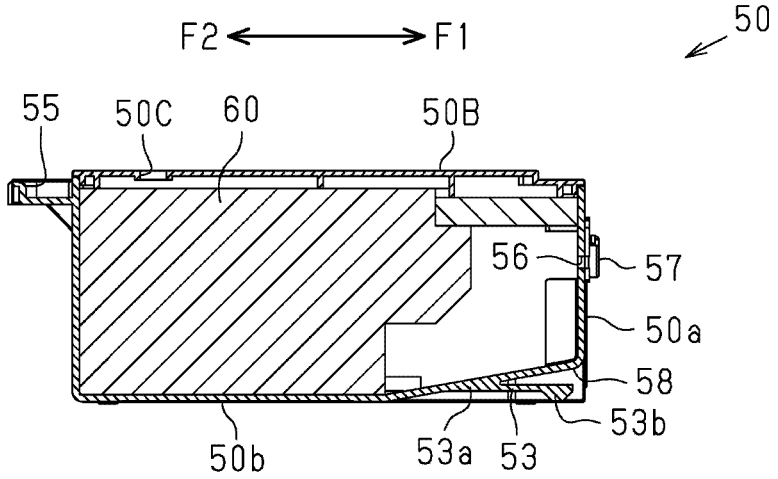
FIG. 7 is a side cross-sectional view of the waste liquid container in the embodiment.

As illustrated in FIG. 7, the bottom surface of the recess portion 58 of the container member 50A is configured as a sloped surface with a downward gradient in the detachment direction F2 opposite to the mounting direction F1 of the waste liquid container 50 on the mounting portion 31. The second end portion of the restricted portion 53 in the lengthwise direction is coupled to the recess portion 58 of the container member 50A. The restricted portion 53 extends along the horizontal direction from the sloped surface of the recess portion 58 of the container member 50A. A lower end position of the restricted portion 53 is flush with the bottom wall portion 50*b* of the container member 50A.

The inside of the container member 50A is an accommodation portion 59 accommodating therein the waste ink discharged from the discharge portion 33. An absorbing member 60 for absorbing the waste ink is arranged in the accommodation portion 59. A surface of the bottom surface of the accommodation portion 59, which is close to the introduction port 56, is configured as a sloped surface with a downward gradient in the detachment direction F2 of the waste liquid container 50. In this case, the absorbing member 60 is arranged at a position on the detachment direction F2 side of the waste liquid container 50 relative to the bottom surface of the accommodation portion 59, which is configured as the sloped surface as described above. That is to say, a gap is interposed in the horizontal direction between the absorbing member 60 and the front wall portion 50*a* of the container member 50A. Therefore, even when a discharging speed of the waste ink to the accommodation portion 59 from the discharge portion 33 is higher than an absorbing speed of the waste ink by the absorbing member 60, overflow of the waste ink from the waste liquid container 50 is suppressed. The waste ink discharged to the accommodation portion 59 from the discharge portion 33 reaches the absorbing member 60 while flowing down the bottom surface of the accommodation portion 59 with gravity force. The absorbing member 60, therefore absorbs the waste ink smoothly.

Next, operations when the waste liquid container 50 in the embodiment is mounted on the mounting portion 31 will be described with reference to the drawings.

Figure 8:
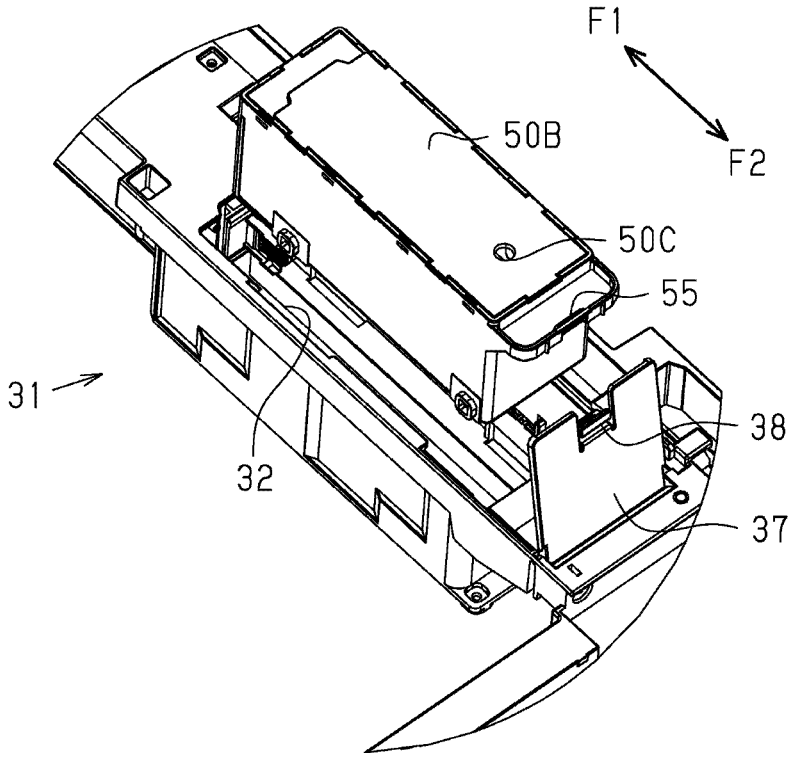
FIG. 8 is an operation view when the waste liquid container in the embodiment is mounted on the mounting portion.

As illustrated in FIG. 8, when the waste liquid container 50 is mounted, first, the waste liquid container 50 is inserted, from the upper side, into the mounting recess portion 32 of the mounting portion 31 in a state in which the cover member 37 of the mounting portion 31 is opened. In this case, a dimension of the mounting recess portion 32 in the lengthwise direction is set to be slightly larger than a dimension of the waste liquid container 50 in the same direction. Therefore, the waste liquid container 50 is movable in the lengthwise direction of the mounting recess portion 32 in a state of being accommodated in the mounting recess portion 32.

Figure 9:
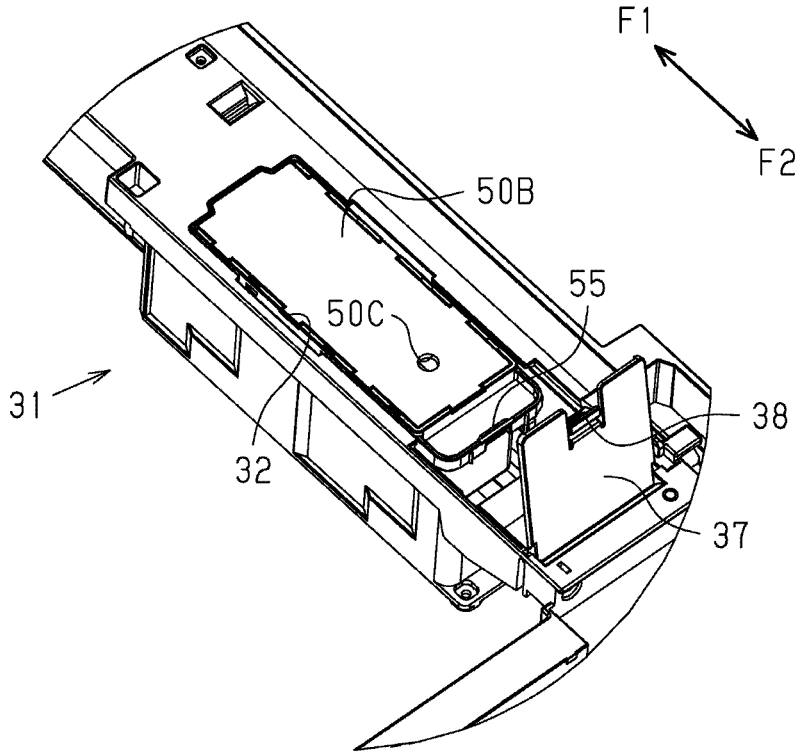
FIG. 9 is an operation view when the waste liquid container in the embodiment is mounted on the mounting portion.

Subsequently, as illustrated in FIG. 9, the waste liquid container 50 is moved in the mounting direction F1 so that it becomes close to the first end portion of the mounting recess portion 32 in the lengthwise direction. In this case, the substrate connecting portion 34 of the mounting portion 31 is inserted into the recess portion 51 of the waste liquid container 50 and the discharge portion 33 of the mounting portion 31 is inserted into the introduction port 56 of the waste liquid container 50. When the waste liquid container 50 is moved to a predetermined position, the restricted portion 53 of the waste liquid container 50 is engaged with the restricting portion 35 of the mounting recess portion 32. With this engagement, the waste liquid container 50 is positioned in the direction along the mounting direction F1.

Figure 10:
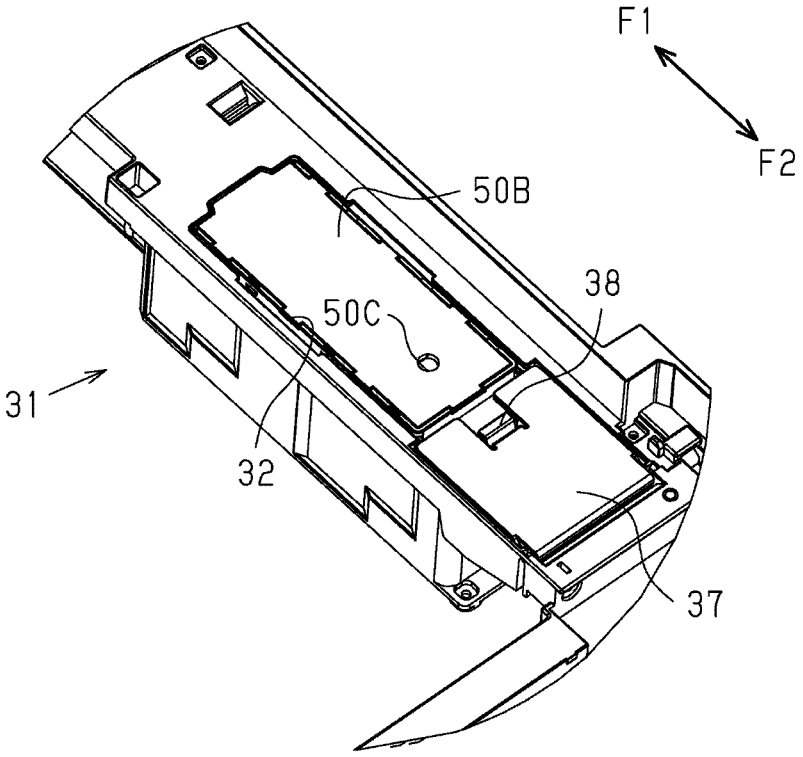
FIG. 10 is an operation view when the waste liquid container in the embodiment is mounted on the mounting portion.

After that, as illustrated in FIG. 10, the cover member 37 is rotationally moved to a position making contact with the waste liquid container 50. In this case, a mounting positioning state of the waste liquid container 50 on the mounting portion 31 is made stable by engagement of the engagement claw 38 of the cover member 37 with the engagement portion 55 of the waste liquid container 50.

Next, the operations when the waste liquid container 50 in the embodiment is mounted on the mounting portion 31 will be described with reference to the drawings while particularly focusing on operations of the restricting portion 35 and the restricted portion 53.

Figure 11A:
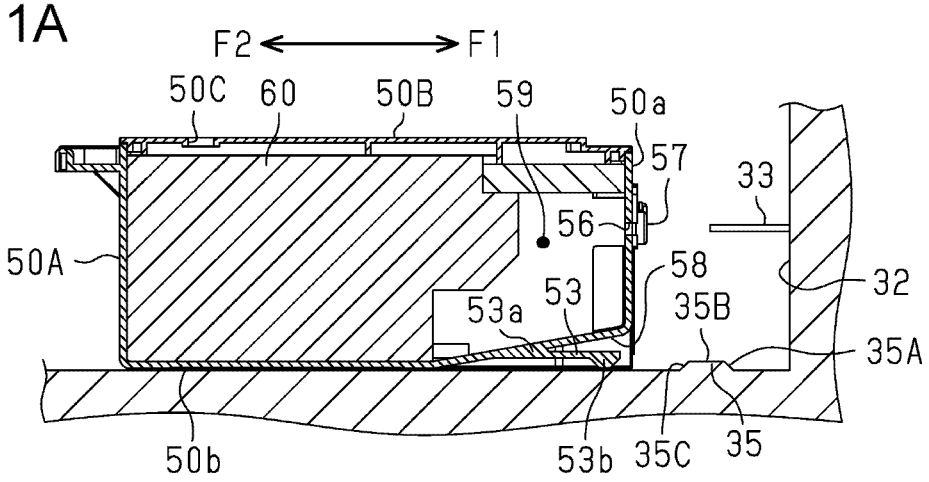
FIGS. 11A to 11C are operation views when the waste liquid container in the embodiment is mounted on the mounting portion.

As illustrated in FIG. 11A, the bottom wall portion 50*b* of the waste liquid container 50 is supported, from the lower side, by the bottom surface of the mounting recess portion 32 in the state in which the waste liquid container 50 is accommodated in the mounting recess portion 32. A small gap is interposed in the horizontal direction between the front wall portion 50*a* of the waste liquid container 50 and the side surface of the mounting recess portion 32, which is located on the first end portion thereof in the lengthwise direction. Further, the introduction port 56 provided in the front wall portion 50*a* of the waste liquid container 50 and the discharge portion 33 provided on the side surface of the mounting recess portion 32, which is located on the first end portion thereof in the lengthwise direction, face each other.

Figure 11B:
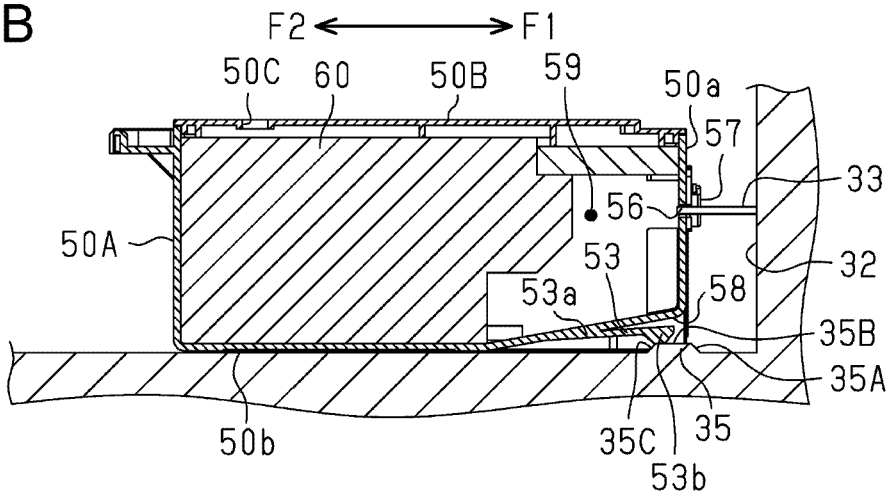

As illustrated in FIG. 11B, when the waste liquid container 50 is moved in the mounting direction F1, the deformation portion 53*a* of the restricted portion 53 is elastically deformed in the direction intersecting with the lengthwise direction and the contact portion 53*b* of the restricted portion 53 climbs on the third surface 35C of the restricting portion 35 provided on the bottom surface of the mounting recess portion 32.

Figure 11C:
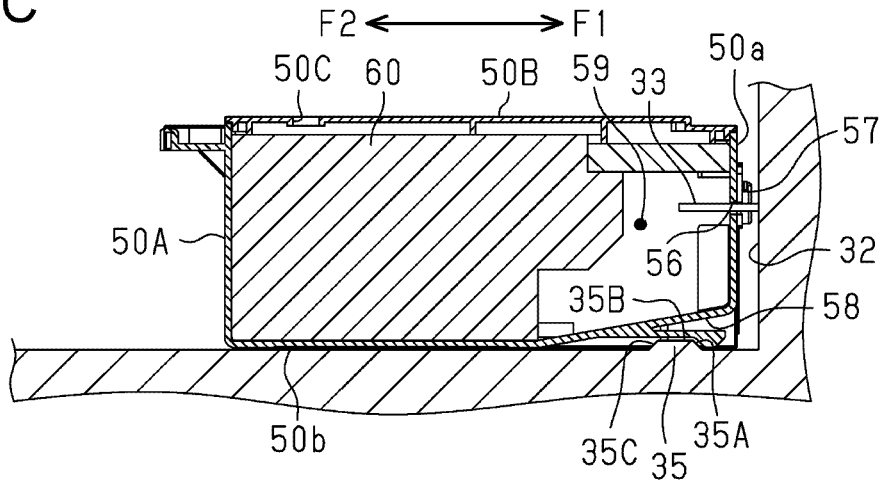

Then, as illustrated in FIG. 11C, when the waste liquid container 50 is further moved in the mounting direction F1, the deformation portion 53*a* of the restricted portion 53 elastically restores after the contact portion 53*b* of the restricted portion 53 climbs over the second surface 35B of the restricting portion 35. With this restoring, the contact portion 53*b* of the restricted portion 53 is engaged with the first surface 35A of the restricting portion 35. In this case, with engagement of the contact portion 53*b* with the first surface 35A of the restricting portion 35 in the detachment direction F2 of the waste liquid container 50, the waste liquid container 50 is positioned on the mounting recess portion 32 in the direction along the mounting direction F1. Further, the discharge portion 33 provided on the mounting recess portion 32 is inserted into the introduction port 56 provided in the waste liquid container 50.

Next, operations when the waste liquid container 50 in the embodiment is detached from the mounting portion 31 will be described with reference to the drawings while particularly focusing on operations of the restricting portion 35 and the restricted portion 53.

Figure 12A:
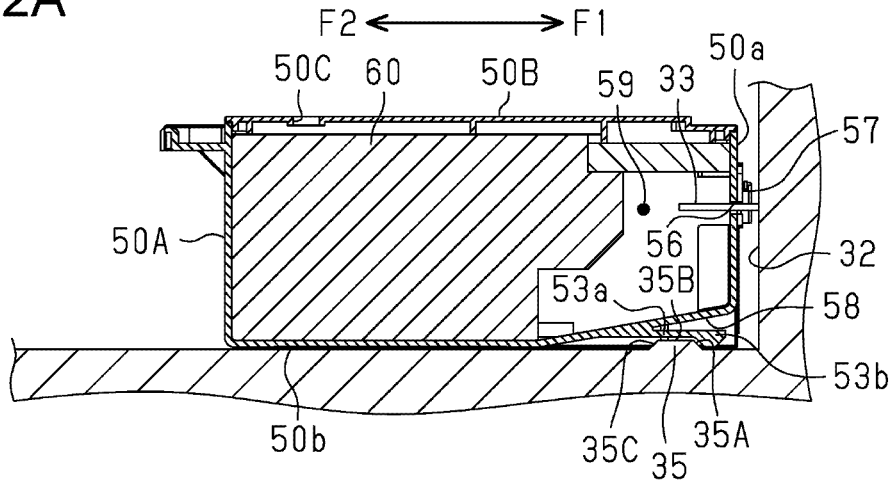
FIGS. 12A to 12C are operation views when the waste liquid container in the embodiment is detached from the mounting portion.

As illustrated in FIG. 12A, the contact portion 53*b* of the restricted portion 53 is in a state of being engaged with the restricting portion 35 in the detachment direction F2 of the waste liquid container 50 in a state in which the waste liquid container 50 is mounted on the mounting recess portion 32.

Figure 12B:
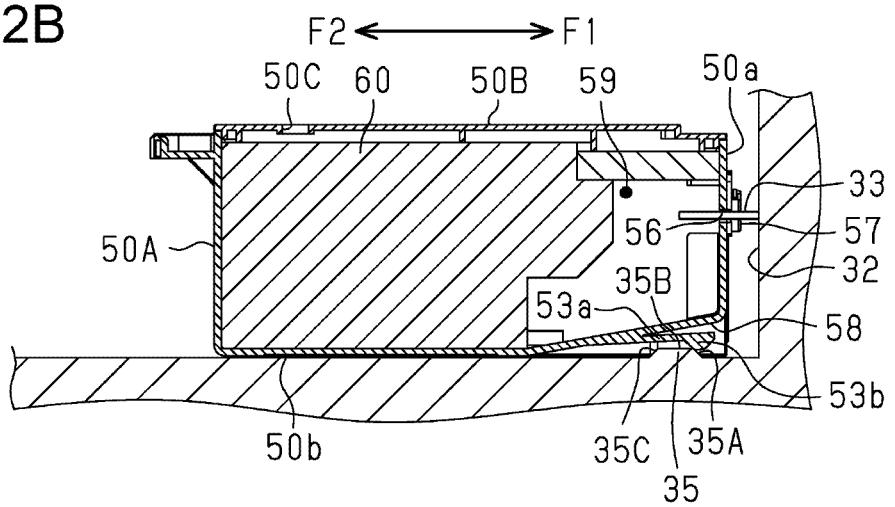

As illustrated in FIG. 12B, when the waste liquid container 50 is further moved in the detachment direction F2, the contact portion 53*b* of the restricted portion 53 climbs on the restricting portion 35 provided on the bottom surface of the mounting recess portion 32. In this case, the first surface 35A of the restricting portion 35 is configured as a sloped surface with an upward gradient in the detachment direction F2 of the waste liquid container 50. Therefore, the contact portion 53*b* smoothly climbs on the first surface 35A of the restricting portion 35.

Figure 12C:
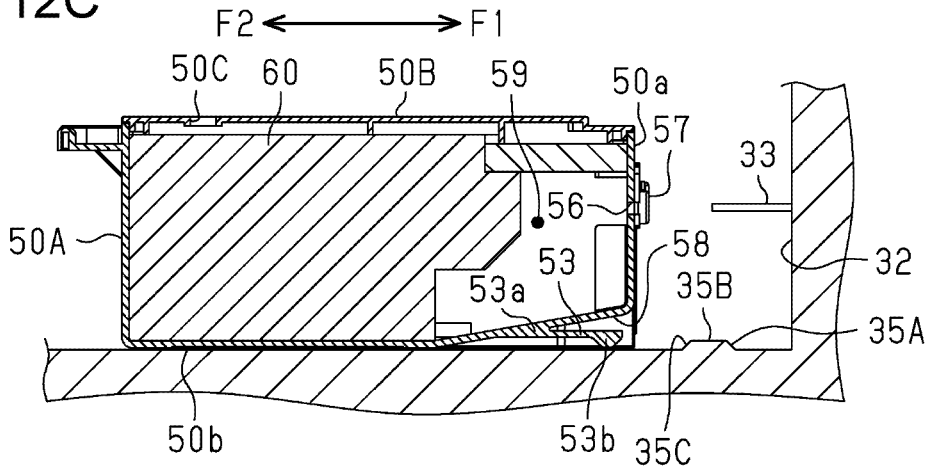

Then, as illustrated in FIG. 12C, when the waste liquid container 50 is further moved in the detachment direction F2, the contact portion 53*b* of the restricted portion 53 climbs over the second surface 35B of the restricting portion 35. In this case, the discharge portion 33 provided on the mounting recess portion 32 is detached from the introduction port 56 provided in the waste liquid container 50.

Next, actions of the waste liquid container 50 in the embodiment will be described.

The discharge portion 33 provided on the mounting portion 31 is inserted into the introduction port 56 of the waste liquid container 50 in the state in which the waste liquid container 50 is mounted on the mounting portion 31. Then, the waste ink discharged by the recording head 17 is discharged to the waste liquid container 50 after passing through the discharge portion 33. In this case, a part of the waste ink discharged to the waste liquid container 50 from the discharge portion 33 leaks from the introduction port 56 of the waste liquid container 50 in some cases.

In this point, in the embodiment, the center of the opening of the introduction port 56 and the contact portion 53*b* of the restricted portion 53 are arranged at the positions that do not overlap with each other in the vertical direction when seen from the side on which the introduction port 56 of the waste liquid container 50 is opened. With this arrangement, even if the waste ink leaked out from the introduction port 56 of the waste liquid container 50 flows down the front wall portion of the waste liquid container 50 to the lower side in the vertical direction with the gravity force as described above, adherence of the waste ink to the contact portion 53*b* of the restricted portion 53 is suppressed. Therefore, in the state in which the waste liquid container 50 is mounted on the mounting portion 31, influences on the attachment and detachment operations of the waste liquid container 50 by adherence of the contact portion 53*b* of the restricted portion 53 to the restricting portion 35 provided on the mounting recess portion 32 with the waste ink interposed therebetween due to the adherence of the waste ink to the contact portion 53*b* of the restricted portion 53 is avoided. Further, transfer, onto the waste liquid container 50 newly mounted on the mounting portion 31, of the waste ink that has adhered to the restricting portion 35 due to transfer of the waste ink onto the restricting portion 35 from the contact portion 53*b* of the restricted portion 53 may be avoided.

In the present embodiment, the connecting terminal 52*a* of the circuit substrate 52 is arranged above the restricted portion 53. Therefore, even if the waste ink leaked out from the introduction port 56 of the waste liquid container 50 adheres to the contact portion 53*b* of the restricted portion 53, reaching of the waste ink to the circuit substrate 52 from the contact portion 53*b* of the restricted portion 53 is suppressed. Occurrence of coupling failure between the connecting terminal 52*a* of the circuit substrate 52 and the substrate connecting portion 34 due to the adherence of the waste ink to the connecting terminal 52*a* of the circuit substrate 52 may be avoided.

The above-described embodiment can provide the following effects.

1. In the waste liquid container 50, the contact portion 53*b* of the restricted portion 53 is arranged at the position that does not overlap with the center of the opening of the introduction port 56 in the vertical direction when seen from the side on which the introduction port 56 is opened. With this configuration, after the waste ink leaked out from the introduction port 56 flows down to the lower side in the vertical direction with the gravity force, adherence of the waste ink to the contact portion 53*b* of the restricted portion 53 can be suppressed.

2. The restricted portion 53 has the deformation portion 53*a* having the end portion in the lengthwise direction, which is coupled to the contact portion 53*b*, and being configured to be elastically deformable in the direction intersecting with the lengthwise direction. With this configuration, the restricted portion 53 is engaged with the restricting portion 35, and attachment and detachment operations of the waste liquid container 50 to and from the mounting portion 31 can be smoothly performed.

3. The restricted portion 53 is accommodated in the recess portion 58 opened to the gravity direction and the mounting direction F1 of the waste liquid container 50. With this configuration, the adherence of the waste ink leaked out from the introduction port 56 to the contact portion 53*b* of the restricted portion 53 can be further suppressed.

4. The restricted portion 53 has the first end portion in the lengthwise direction, which is coupled to the contact portion 53*b*, and the second end portion in the lengthwise direction, which is coupled to the recess portion 58. With this configuration, reaching of the waste ink leaked out from the introduction port 56 to the contact portion 53*b* while flowing down the inner surface of the recess portion 58 can be suppressed.

5. The second end portion of the restricted portion 53 is arranged on the detachment direction F2 side relative to the contact portion 53*b*. With this configuration, the reaching of the waste ink leaked out from the introduction port 56 to the contact portion 53*b* while flowing down the inner surface of the recess portion 58 can be further suppressed.

6. The connecting terminal 52*a* of the circuit substrate 52 is arranged on the upper side relative to the restricted portion 53 in the state in which the waste liquid container 50 is mounted on the mounting portion 31. With this configuration, even if the waste ink leaked out from the introduction port 56 adheres to the contact portion 53*b* of the restricted portion 53, reaching of the waste ink to the connecting terminal 52*a* of the circuit substrate 52 from the contact portion 53*b* can be suppressed.

7. The connecting terminal 52*a* of the circuit substrate 52 is arranged so as to face toward the outer side in the width direction which is the direction intersecting with both of the gravity direction and the mounting direction F1. With this configuration, even if the waste ink leaked out from the introduction port 56 adheres to the contact portion 53*b* of the restricted portion 53, the reaching of the waste ink to the connecting terminal 52*a* of the circuit substrate 52 from the contact portion 53*b* can be further suppressed.

8. The waste liquid container 50 includes the guided portions 54 that are guided by the guide portions 36 provided in the mounting portion 31 when being mounted on the mounting portion 31. With this configuration, the mounting operation of the waste liquid container 50 on the mounting portion 31 can be smoothly performed.

9. The guided portions 54 are arranged on the detachment direction F2 side of the waste liquid container 50 relative to the circuit substrate 52. With this configuration, when the waste liquid container 50 is mounted on the mounting portion 31, the substrate connecting portion 34 provided on the mounting portion 31 and the connecting terminal 52*a* of the circuit substrate 52 can be connected to each other properly.

The above-described embodiment may be changed as in the following variations. Further, appropriate combinations of the above-described embodiment and the following variations may configure further variations, and appropriate combinations of the following variations may configure further variations.

In the above-described embodiment, the present disclosure may be applied to an apparatus of a type that an attachment and the waste liquid container 50 are coupled to each other with an ink flow path interposed therebetween while the attachment is mounted on the mounting portion 31 instead of the waste liquid container 50.

In the above-described embodiment, in the waste liquid container 50, the guided portions 54 may be arranged on the mounting direction F1 side relative to the circuit substrate 52.

In the above-described embodiment, the waste liquid container 50 may not include the guided portions 54 that are guided by the guide portions 36 provided in the mounting portion 31 when being mounted on the mounting portion 31.

In the above-described embodiment, the connecting terminal 52*a* of the circuit substrate 52 may be arranged so as to face toward the lower side in the vertical direction or may be arranged so as to face toward the upper side in the vertical direction.

In the above-described embodiment, the circuit substrate 52 may be arranged at the lower side relative to other sites of the restricted portion 53 than the contact portion 53*b* as long as the connecting terminal 52*a* thereof is arranged at the upper side relative to the contact portion 53*b* of the restricted portion 53 in the state in which the waste liquid container 50 is mounted on the mounting portion 31.

In the above-described embodiment, the connecting terminal 52*a* of the circuit substrate 52 may be arranged at the same height as the restricted portion 53 or may be arranged at the lower side relative to the restricted portion 53 in the state in which the waste liquid container 50 is mounted on the mounting portion 31.

In the above-described embodiment, the second end portion of the restricted portion 53 in the lengthwise direction may be coupled to the recess portion 58 at a position on the mounting direction F1 side relative to the contact portion 53*b*.

In the above-described embodiment, the second end portion of the restricted portion 53 in the lengthwise direction may be coupled to a site differing from the recess portion 58, such as on the bottom wall portion 50*b* of the waste liquid container 50, for example.

In the above-described embodiment, a part of the restricted portion 53 may project from the recess portion 58. For example, the contact portion 53*b* coupled to the first end portion of the restricted portion 53 in the lengthwise direction may project relative to the front wall portion 50*a* of the waste liquid container 50 through the front opening of the recess portion 58.

In the above-described embodiment, the restricted portion 53 may not include the deformation portion 53*a* that is deformed in the direction intersecting with the lengthwise direction.

In the above-described embodiment, in the waste liquid container 50, other sites of the restricted portion 53 than the contact portion 53*b* may be arranged so as to overlap with the center of the opening of the introduction port 56 in the vertical direction as long as the contact portion 53*b* of the restricted portion 53 is arranged so as not to overlap with the center of the opening of the introduction port 56 in the vertical direction when seen from the side on which the introduction port 56 is opened.

In the above-described embodiment, in the waste liquid container 50, the container member 50A and the restricted portion 53 may be configured by separate members.

In the above-described embodiment, the liquid ejecting apparatus may include a liquid ejecting head ejecting liquid other than the ink, for example, a liquid material formed by dispersing or mixing particles of a functioning material in the liquid. For example, the liquid ejecting head may eject a liquid material in a form of a solution or a dispersion of a material such as an electrode material or a coloring material (pixel material) to be used for manufacturing a liquid crystal display, an electro luminescence (EL) display, a field emission display, and so on.

In the above-described embodiment, the waste liquid container 50 may accommodate therein liquefied waste liquid by collecting mist which has scattered with liquid ejection or the like, or may accommodate not only liquid to be used for ejection onto a target but also various types of functioning liquid such as washing liquid used for washing the liquid ejecting head or the like.

In the above-described embodiment, the apparatus on which the waste liquid container 50 is mounted may be any apparatus other than the liquid ejecting apparatus as long as the apparatus causes the used liquid to be discharged through the discharge portion 33. Examples of such apparatuses include a washing apparatus that washes a target with liquid such as water and an inspection apparatus that performs inspection and the like using inspection liquid.

Hereinafter, technical spirits that are grasped from the above-described embodiment and variations will be described together with effects.

First Aspect

A waste liquid container that is mounted on a mounting portion having a discharge portion for discharging waste liquid and a restricting portion provided under the discharge portion in a detachable manner with movement in a mounting direction intersecting with a gravity direction includes a waste liquid introduction portion being coupled to the discharge portion when the waste liquid container is mounted on the mounting portion, an accommodation portion accommodating the waste liquid discharged from the discharge portion, and a restricted portion having a contact portion configured to make contact with the restricting portion and restricting movement of the waste liquid container in a detachment direction opposite to the mounting direction by contact between the contact portion and the restricting portion in a state in which the waste liquid container is mounted on the mounting portion, wherein the contact portion is arranged at a position which does not overlap with a center of an opening of the waste liquid introduction portion in a vertical direction when seen from a side on which the waste liquid introduction portion is opened.

With this configuration, after the waste liquid leaked out from the waste liquid introduction portion flows down to the lower side in the vertical direction with the gravity force, adherence of the waste liquid to the contact portion of the restricted portion can be suppressed.

Second Aspect

In the waste liquid container according to the first aspect, the restricted portion may have a deformation portion having an end portion in the lengthwise direction, which is coupled to the contact portion, and being configured to be elastically deformable in a direction intersecting with the lengthwise direction.

With this configuration, attachment and detachment operations of the waste liquid container to and from the mounting portion can be smoothly performed in the configuration in which the restricted portion is engaged with the restricting portion.

Third Aspect

In the waste liquid container according to the first or second aspect, the restricted portion may be accommodated in a recess portion opened to a gravity direction and the mounting direction.

With this configuration, the adherence of the waste liquid leaked out from the waste liquid introduction portion to the contact portion of the restricted portion can be further suppressed.

Fourth Aspect

In the waste liquid container according to the third aspect, the restricted portion may have a first end portion in the lengthwise direction, which is coupled to the contact portion, and a second end portion in the lengthwise direction, which is coupled to the recess portion.

With this configuration, reaching of the waste liquid leaked out from the waste liquid introduction portion to the contact portion while flowing down the inner surface of the recess portion can be suppressed.

Fifth Aspect

In the waste liquid container according to the fourth aspect, the second end portion of the restricted portion may be arranged on the detachment direction side relative to the contact portion.

With this configuration, the reaching of the waste liquid leaked out from the waste liquid introduction portion to the contact portion while flowing down the inner surface of the recess portion can be further suppressed.

Sixth Aspect

The waste liquid container according to any one of the first to fifth aspects may further include a circuit substrate having a connecting terminal that is electrically connected to a substrate connecting portion provided on the mounting portion in mounting on the mounting portion, wherein the connecting terminal of the circuit substrate is arranged on an upper side relative to the restricted portion in a state in which the waste liquid container is mounted on the mounting portion.

With this configuration, even if the waste liquid leaked out from the waste liquid introduction portion adheres to the contact portion of the restricted portion, the reaching of the waste liquid to the connecting terminal of the circuit substrate from the contact portion can be suppressed.

Seventh Aspect

In the waste liquid container according to the sixth aspect, the connecting terminal of the circuit substrate may be arranged so as to face toward an outer side in a width direction which is a direction intersecting with both of a gravity direction and the mounting direction.

With this configuration, even if the waste liquid leaked out from the waste liquid introduction portion adheres to the contact portion of the restricted portion, the reaching of the waste liquid to the connecting terminal of the circuit substrate from the contact portion can be further suppressed.

Eighth Aspect

The waste liquid container according to any one of the first to seventh aspects may further include a guided portion that is guided by a guide portion provided in the mounting portion when the waste liquid container is mounted on the mounting portion.

With this configuration, a mounting operation of the waste liquid container on the mounting portion can be smoothly performed.

Ninth Aspect

In the waste liquid container according to the eighth aspect, the guided portion may be arranged on the detachment direction side relative to a circuit substrate.

With this configuration, when the waste liquid container is mounted on the mounting portion, the coupling portion provided on the mounting portion and the connecting terminal of the circuit substrate can be connected to each other properly.

Tenth Aspect

An attachment that is mounted on a mounting portion having a discharge portion for discharging waste liquid and a restricting portion provided under the discharge portion in a detachable manner with movement in a mounting direction intersecting with a gravity direction includes a waste liquid introduction portion being coupled to the discharge portion when the attachment is mounted on the mounting portion, an accommodation portion accommodating the waste liquid discharged from the discharge portion through the waste liquid introduction portion, and a restricted portion having a contact portion configured to make contact with the restricting portion and restricting movement of the attachment in a detachment direction opposite to the mounting direction by contact between the contact portion and the restricting portion in a state in which the attachment is mounted on the mounting portion, wherein the contact portion is arranged at a position which does not overlap with a center of an opening of the waste liquid introduction portion in a vertical direction when seen from a side on which the waste liquid introduction portion is opened.

With this configuration, after the waste liquid leaked out from the waste liquid introduction portion flows down to the lower side in the vertical direction with the gravity force, adherence of the waste liquid to the contact portion of the restricted portion can be suppressed.

What is claimed is:

1. A waste liquid container that is mounted on a mounting portion having a discharge portion for discharging waste liquid and a restricting portion provided under the discharge portion and that is configured to attach and detach with movement in a mounting direction intersecting with a gravity direction, the waste liquid container comprising:

a waste liquid introduction portion being coupled to the discharge portion when the waste liquid container is mounted on the mounting portion;

an accommodation portion accommodating the waste liquid discharged from the discharge portion; and a restricted portion having a contact portion configured to make contact with the restricting portion and in which movement of the waste liquid container is restricted in a detachment direction opposite to the mounting direction by contact between the contact portion and the restricting portion in a state in which the waste liquid container is mounted on the mounting portion, wherein the restricted portion is provided in a recess portion opened to a gravity direction and the mounting direction, when seen from a side on which the waste liquid introduction portion is opened, the recess portion is arranged at a position which overlaps with a center of an opening of the waste liquid introduction portion in a vertical direction, and the contact portion is arranged at a position which does not overlap with the center of the opening of the waste liquid introduction portion in the vertical direction.

2. The waste liquid container according to claim 1, wherein the restricted portion has a deformation portion having an end portion in the lengthwise direction, which is coupled to the contact portion, and being configured to be elastically deformed in a direction intersecting with the lengthwise direction.

3. The waste liquid container according to claim 1, wherein the recess portion is arranged at the position which overlaps with the waste liquid introduction portion in the vertical direction.

4. The waste liquid container according to claim 3, wherein the restricted portion has a first end portion in the lengthwise direction, which is coupled to the contact portion, and a second end portion in the lengthwise direction, which is coupled to the recess portion.

5. The waste liquid container according to claim 4, wherein the second end portion of the restricted portion is arranged on the detachment direction side relative to the contact portion.

6. The waste liquid container according to claim 1, further comprising a circuit substrate having a connecting terminal that is electrically connected to a substrate connecting portion provided on the mounting portion in mounting on the mounting portion, wherein the connecting terminal of the circuit substrate is arranged on an upper side relative to the restricted portion in a state in which the waste liquid container is mounted on the mounting portion.

7. The waste liquid container according to claim 6, wherein the connecting terminal of the circuit substrate is arranged so as to face toward an outer side in a width direction as a direction intersecting with both of a gravity direction and the mounting direction.

8. The waste liquid container according to claim 1, further comprising a guided portion that is guided by a guide portion provided in the mounting portion when the waste liquid container is mounted on the mounting portion.

9. The waste liquid container according to claim 8, wherein the guided portion is arranged on the detachment direction side relative to a circuit substrate.

10. An attachment that is mounted on a mounting portion having a discharge portion for discharging waste liquid and a restricting portion provided under the discharge portion and that is configured to attach and detach with movement in a mounting direction intersecting with a gravity direction, the attachment comprising:

a waste liquid introduction portion being coupled to the discharge portion when the attachment is mounted on the mounting portion; and a restricted portion having a contact portion configured to make contact with the restricting portion and restricting movement of the attachment in a detachment direction opposite to the mounting direction by contact between the contact portion and the restricting portion in a state in which the attachment is mounted on the mounting portion, wherein the restricted portion is provided in a recess portion opened to a gravity direction and the mounting direction, when seen from a side on which the waste liquid introduction portion is opened, the recess portion is arranged at a position which overlaps with a center of an opening of the waste liquid introduction portion in a vertical direction, and the contact portion is arranged at a position which does not overlap with the center of the opening of the waste liquid introduction portion in the vertical direction.

* * * * *